US005232355A

United States Patent [19]

Fujii et al.

[11] Patent Number: 5,232,355

[45] Date of Patent: Aug. 3, 1993

[54] SCROLL-TYPE FLUID APPARATUS HAVING A LABYRINTH AND OIL SEALS SURROUNDING A SCROLL SHAFT

[75] Inventors: Kozaburo Fujii; Yutaka Yamasaki, both of Fukuoka, Japan

[73] Assignee: Mitsubishi Denki K.K., Tokyo, Japan

[21] Appl. No.: 882,277

[22] Filed: May 13, 1992

[30] Foreign Application Priority Data

May 17, 1991 [JP] Japan ..... 3-140645

[51] Int. Cl.[5] ..... F04C 18/04; F04C 27/00; F04C 29/02

[52] U.S. Cl. ..... 418/55.2; 418/55.4; 418/55.6; 418/88; 418/141; 418/188

[58] Field of Search ..... 418/55.2, 55.4, 55.6, 418/88, 141, 188

[56] References Cited

U.S. PATENT DOCUMENTS

| | | | |
|---|---|---|---|
| 3,369,740 | 2/1968 | Abermeth | 418/141 |
| 4,743,181 | 5/1988 | Murayama et al. | 418/55.4 |
| 4,973,232 | 11/1990 | Etou et al. | 418/55.6 |
| 5,131,828 | 7/1992 | Richardson, Jr. et al. | 418/55.4 |

FOREIGN PATENT DOCUMENTS

| | | | |
|---|---|---|---|
| 53-102440 | 9/1978 | Japan . | |
| 57-195995 | 12/1982 | Japan . | |
| 58-121320 | 7/1983 | Japan . | |
| 2112690 | 4/1990 | Japan | 418/55.4 |

*Primary Examiner*—John J. Vrablik
*Attorney, Agent, or Firm*—Sughrue, Mion, Zinn, Macpeak & Seas

[57] ABSTRACT

A scroll-type fluid apparatus includes a housing whose interior is divided by upper and lower partitioning walls into chambers one over another, i.e., a discharge chamber communicating with a discharge port, an inlet chamber communicating with an inlet port and a drive chamber accommodating therein a motor. A first scroll member is disposed in the inlet chamber and has a lower surface formed integral with a first spiral scroll vane. A second scroll member is disposed in the inlet chamber at a location below the first scroll member and has a lower surface provided with a rotatable shaft which is rotatably supported in the lower partitioning wall. The second scroll member is integrally provided on an upper surface thereof with a second spiral scroll vane which is in mesh with the first scroll vane to form a plurality of variable-volume chambers. An oil pump is provided in the discharge chamber for supplying lubricant to contacting parts of the first and second scroll members. The rotatable shaft of the second scroll member is provided on the outer periphery thereof with a labyrinth seal and at least one annular oil seal for preventing leakage of lubricating oil and vacuum from the inlet chamber toward the drive chamber.

19 Claims, 8 Drawing Sheets (a)
ANGLE OF ROTATION : 0°

(b)
ANGLE OF ROTATION : 90°

(d)
ANGLE OF ROTATION : 270°

(c)
ANGLE OF ROTATION : 180°

SCROLL-TYPE FLUID APPARATUS HAVING A LABYRINTH AND OIL SEALS SURROUNDING A SCROLL SHAFT

BACKGROUND OF THE INVENTION

This invention relates to scroll-type fluid apparatus such as scroll-type vacuum pumps, scroll-type compressors and the like. More particularly, it relates to a scroll-type fluid apparatus which has an inlet chamber accommodating therein first and second scroll members which cooperate to define a variable volume chamber in the inlet chamber. More specifically, the invention is concerned with such an apparatus capable of effectively preventing lubricant, which lubricates and seals the first and second scroll members, from leaking from the inlet chamber to a drive chamber accommodating a drive means for driving the scroll members.

FIG. 11 shows a typical example of a conventional scroll-type fluid apparatus in the form of a scroll-type vacuum pump. Referring to the Figure, the illustrated scroll-type vacuum pump has a cylindrical housing 101, in which a pair of, i.e., upper and lower, disk-like partitioning walls 102 are disposed one above another. Between the partitioning walls 102 and 103 is defined an inlet chamber 105 in the form of a pump chamber communicating with an intake port 104. A drive chamber 106 is defined by the lower partitioning wall 103 and the cylindrical peripheral surface and bottom surface of the housing 101. An annular spacer 107 is interposed between the upper and lower partitioning walls 102 and 103. The spacer 107 is secured to the annular peripheral wall of the housing 101, and the upper and lower partitioning walls 102 and 103 are secured by bolts or the like to the respective upper and lower end surfaces of the spacer 107.

In the pump chamber 105 there is disposed a pair of, i.e., first and second scroll members 110 and 111 one above another. The first scroll member 111 in the form of a drive scroll member has a lower end disk **111*a* and a spiral drive scroll vane 111*b* integral with and projecting from the center of the top of the lower end disk 111*a*. The lower surface 111*a* of the lower end disk 111*a* is rotatably supported on the upper surface of the lower partitioning member 103 via a thrust bearing 112. The lower end disk 111*a* has a shaft 111*c* extending downward from its center and penetrating the lower partitioning member 103. The shaft 111*c* is rotatably supported in a central part of the lower partitioning wall 103 via a pair of, i.e., upper and lower, bearings 113. The second scroll member 110 in the form of a driven scroll member has an upper end disk 110*a* facing in parallel to the top of the lower end disk 111*a* of the drive scroll member 111 and a spiral driven scroll vane 110*b* which is integral with and projects from the neighborhood of the center of the lower surface of the upper end disk 110*a*. A shaft 110*c* extending upwardly from the center of the upper surface of the upper end disk 110*a* is rotatably supported substantially in a central part of the upper partitioning wall 102 via a pair of, i.e., upper and lower, bearings 114. The axis 01 of the shaft 110*c* is eccentric by a fixed distance L with respect to the axis 02 of the shaft 111*c* of the lower end disk 111*b***. The distance L is given as $$L=P/2-t$$

where P represents the pitch of the scroll vanes **110*b* and 111*b* (i.e., the distance between adjacent vanes) and t represents the width (i.e., thickness) of the scroll vanes 110*b* and 111*b***.

The scroll vanes **110*b* and 111*b* of the driven and drive scroll members 110 and 111 are disposed such that they are in mesh with each other with their respective upper and lower end surfaces in contact with the inner surfaces of the upper and lower end disks 110*a* and 111*a*. Between these scroll vanes are defined several crescent variable-volume chambers 115 with their volumes being varied with the rotation of the driven and drive scroll members 110 and 111. The driven and drive scroll vanes 110*b* and 111*b* have their respective upper and lower end surfaces formed with spiral seal grooves, in which seal members 116 and 117 are accommodated to effect hermetical seals between the upper and lower end surfaces of the scroll vanes 110*b* and 111*b* on one hand, and the corresponding inner surfaces of the upper and lower end disks 110*a* and 111*b* on the other hand. A thrust bearing 118 is disposed between the upper surface of the upper end disk 110*a* and lower end surface of the upper partitioning wall 102. The upper end disk 110*a* and the shaft 111*c* are each formed at their central part with an exhaust duct 119 axially penetrating them. The upper end of the exhaust duct 119 is connected to one end of an exhaust tube 120, the other end portion of which extends to the outside of the housing 101**.

The top of the upper partitioning wall 102 has an integral central annular projection 121 defining an annular oil reservoir **121*a* open at the top. The oil reservoir 121*a* is sealed by removably mounting a cover 122 by means of bolts 128 on the top surface of the projection 121. It is connected via an oil supply duct 124 to an oil pump 123 disposed in the drive chamber 106, and it can supply oil, i.e., lubricant, 125 through the oil supply duct 124 with the operation of the oil pump 123. The oil 125 in the oil reservoir 121*a* is supplied via radial and axial oil ducts 126 and 127 formed in the shaft 110*c* of the drive scroll member 110 to the variable-volume chambers 115 formed between the driven and drive scroll vanes 110*b* and 111*b*. Thus, it lubricates the contact parts of the driven and drive scroll vanes 110*b* and 111*b* and upper and lower end disks 110*b* and 111*a* during rotation of the driven and drive scroll members 110 and 111, and it also effects a hermetical seal between contact parts S of the inner and outer peripheral surfaces of the scroll vanes 110*b* and 111*b* (see (a) in FIG. 12). The oil 125 having lubricated the rotational contact parts of the drive and driven scroll vanes 110*b* and 111*b* is discharged along with compressed gas through the exhaust duct 119 to the outside, while it is partly collected in a lower portion of the pump chamber 105 to leak around the outer periphery of the shaft 111*c* into the drive chamber 106** so as to be collected in a lower portion thereof.

The inner surface of the cover 122, which is fitted on the projection 121 of the upper partitioning wall 102, is provided with a stationary mechanical seal 130 surrounding the duct 120 penetrating the cover 122. The upper end of the shaft **110*c* extending from the upper end disk 110*b* into the oil reservoir 121*a* is provided with a rotational mechanical seal 131 surrounding the exhaust duct 120. The lower end of the fixed mechanical seal is urged by the upper surface of the rotational mechanical seal 131, so that a hermetical seal is provided between the contact parts of the exhaust duct 119 and the exhaust tube 120**.

Disposed in the drive chamber 106 is a rotary drive means 133 in the form of a motor having an output or rotary shaft 133*a* thereof made integral at the upper end thereof with the shaft 111*c* of the lower end disk 111*a*. The motor 133 has a stator 135 secured by a support 134 to the peripheral wall of the housing 101 and a rotor 136 secured to the shaft 133*a*. The shaft 133*a* has its lower end portion coupled to the oil pump 123. Thus, with the rotation of the motor 133, the oil pump 123 is driven, whereby the oil 125 collected in a lower portion of the drive chamber 106 is supplied through the oil supply duct 124 to the oil reservoir 121*a*.

The above-described scroll-type vacuum pump operates as follows. When the motor 133 is energized, the drive scroll member 111 is thereby caused to rotate through the motor shaft 113*a* about an axis $0_2$ thereof. In this state, as shown at (b) in FIG. 12, in left-side contacting portions or lines A which are formed by contacting between the driven and drive scroll vanes 110*b* and 111*b* of the driven and drive scroll members 110 and 111 and which are located on the left side of the central axis $0_2$ of the motor shaft 113*a*, the outer peripheral surface of the driven scroll vane 110*b* of the driven scroll member 110 is in contact with the inner peripheral surface of the drive scroll vane 111*b* of the drive scroll member 111. At the left-side contacting portions A, the inner periphery of the driven scroll vane 120*b* undergoes motion at this time such that its radius is decreasing. Therefore, the rotation of the drive scroll vane 111*b* causes synchronous rotation of the driven scroll vane 110*b* while being in contact with the outer periphery of driven scroll vane 110*b*. Since the center of rotation $O_2$ of the drive scroll vane 111*b* is eccentric with respect to the center of rotation $O_1$ of the driven scroll vane 110*b*, the volumes of the variable-volume chambers 115 defined between the drive and driven scroll vanes 111*b* and 110*b* are progressively decreasing with the synchronous rotation of the scroll vanes, thus gradually compressing the gas in the variable-volume chambers 115. While the drive and driven scroll vanes 111*b* and 110*b* are synchronously rotated for gas compression, the reaction torque accompanying the gas compression in the variable-volume chambers 115 defined between the scroll vanes is applied evenly to both of the drive and driven scroll vanes 111*b* and 110*b*. The reaction torque applied to the drive scroll vane 111*b* is partially canceled by the output torque of the motor 133. On the other hand, the driven scroll vane 110*b* tends to be rotated by the applied reaction torque about the axis $O_1$ of the shaft 110 in the direction opposite to the direction of rotation of the drive scroll vane 111*b*. This reverse rotation, however, is prevented by the contact between the outer periphery of the driven scroll vane 110*b* and the inner periphery of the drive scroll vane 111*b* in the contacting portions A, as shown at (b) in FIG. 12. Therefore, with the rotation of the drive scroll vane 111*b*, the volumes of the variable-volume chambers 115 are gradually decreasing to compress the gas therein. When the gas is compressed to a minimum volume, the variable-volume chambers 115 are placed into fluid communication with the exhaust duct 119, whereupon the compressed gas under a high pressure is discharged or exhausted through the exhaust duct 119 and the exhaust tube 120 to the outside. In this way, the gas in the pump chamber 105 is exhausted to the outside, thus generally reducing the inner pressure therein.

As described above, the driven scroll member 110 is driven to rotate with the rotation of the drive scroll member 111. If, however, the driven scroll member 110 tends to be rotated faster than the drive scroll member 111 , the driven scroll vane 110*b* is gradually separated from the drive scroll vane 111*b* in the portions A as shown at (b) in FIG. 12, thus producing gaps between these scroll vanes. For this reason, no drive force is transmitted from the driven scroll vane 110*b* to the drive scroll vane 111*b*. In the above state, however, in contacting portions or lines B which are formed by contacting between the drive and driven scroll vanes 11*b*, and which are located on the right side of the central axis $O_1$ of the shaft 110*c* as illustrated at (b) in FIG. 12, the radius of the inner periphery of the driven scroll vane 110*b* is decreasing, while the radius of the outer periphery of the drive scroll vane 111*b* is increasing. As a result, the contact between the inner periphery of the driven scroll vane 110*b* and the outer periphery of the drive scroll vane 111*b* is rapidly increased or strengthened to provide for braking. Thus, faster rotation of the driven scroll vane 110*b* than that of the drive scroll vane 111*b* is automatically restricted.

When the motor 133 is stopped, the drive scroll member 111 begins to decelerate. At this time, the driven scroll member 110 tends to be rotated at a speed higher than that of the drive scroll member 111 due to its inertia. In this state, in the portions B at (b) in FIG. 12, the contact between the inner periphery of the driven scroll vane 110*b* and outer periphery of the drive scroll vane 111*b* is increased, and the driven scroll vane 110*b* is decelerated by the drive scroll vane 111*b* so that both the scroll vanes 110*b*, 111*b* are rotated synchronously.

With the known scroll vacuum pump having the above construction, however, if water vapor or corrosive gas is contained in the gas drawn into the pump, it is very likely that water or corrosive matter is introduced into the oil 125 in the pump chamber 105. In a such case, the oil 125 is liable to cause corrosion, reduction in electrical insulation and the like of the motor 133 which is accommodated in the drive chamber 106. Therefore, the scroll-type vacuum pump can find only specific and limited applications where there arises no problem even if water or corrosive matter is introduced into the lubricant oil.

SUMMARY OF THE INVENTION

Accordingly, the present invention seeks to overcome the above problems encountered with the aforementioned known scroll-type fluid apparatus.

An object of the invention is to provide a scroll-type fluid apparatus which is able to prevent water or corrosive matter contained, if any, in lubricant for lubricating rotating contact parts thereof from being introduced into lubricant supplied to a drive chamber accommodating a drive means, thus preventing corrosion or deterioration in electrical insulation of the drive means such as a motor so as to permit an extended period of use and a variety of applications thereof.

In order to achieve the above objects, according to the present invention, there is provided a scroll-type fluid apparatus comprising: a housing having an inlet port for drawing fluid and a discharge port of discharging the fluid, the housing having an inlet chamber communicating with the inlet port and a drive chamber defined by a first and a second partitioning wall; a first scroll member disposed in the inlet chamber and supported by the first partitioning wall, the first scroll member being provided on one surface thereof with a first spiral scroll vane, the first scroll member having a discharge passage formed through a central portion thereof for communication with the discharge port; a second scroll member disposed in the inlet chamber in an eccentric relation with respect to the first scroll member and being provided on one surface thereof with a second spiral scroll vane which is in mesh with the first scroll vane to define, in cooperation therewith, a plurality of variable-volume chambers, the first and second scroll members having sliding portions which are lubricated by lubricating oil; a rotatable shaft connected with the other surface of the second scroll member and extending through the second partitioning wall, the rotatable shaft being rotatably supported by the second partitioning wall; drive means disposed in the drive chamber and coupled to the rotatable shaft of the second scroll member for rotatively driving it so that the second scroll member is thereby rotated to change the volumes of the variable-volume chambers whereby fluid is drawn through the inlet port into the variable-volume chamber, varied in its volume and discharged from the discharge port through the discharge passage in the first scroll member; and seal means for preventing the lubricating oil in the inlet chamber from leaking around the outer periphery of the rotatable shaft of the second scroll member into the drive chamber, the seal means comprising a labyrinth seal disposed to surround the rotatable shaft of the second scroll member, and a first oil seal disposed at a lower portion of the inlet chamber so as to provide a well in the inlet chamber for storing the lubricating oil.

The above and other objects, features and advantages of the invention will more readily become apparent from the ensuing detailed description of preferred embodiments of the invention taken in conjunction with the accompanying drawings.

BRIEF DESCRIPTION OF THE DRAWINGS

In the accompanying drawings and the following description, the same or corresponding parts are identified by the same symbols.

DESCRIPTION OF THE PREFERRED EMBODIMENTS

Figure 1:
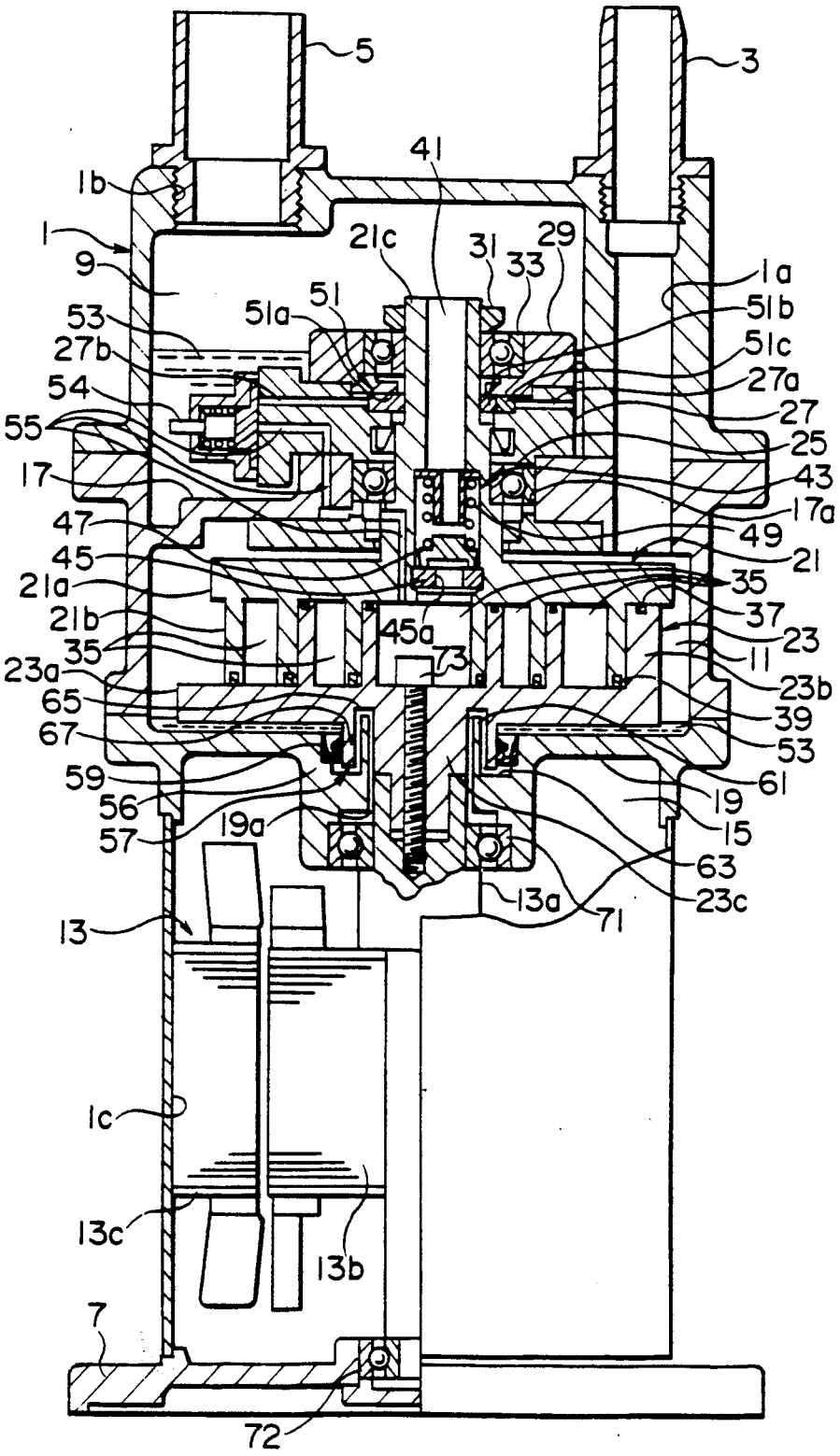
FIG. 1 is a vertical cross section of a scroll-type fluid apparatus in accordance with one embodiment of the present invention.

Embodiments of the present invention will now be described with reference to the accompanying drawings. FIG. 1 shows in vertical cross section a scroll-type fluid apparatus according to a first embodiment of the present invention. In this embodiment, the present invention is applied to a scroll-type vacuum pump. In FIG. 1, the scroll-type vacuum pump has a substantially cylindrical housing 1, the top of which has an inlet port 1*a* and a discharge port 1*b*. Connected to these ports 1*a*, 1*b* are an inlet tube 3, which can be connected to an object (not shown) to be evacuated, and a discharge tube 5. The housing 1 is provided at its bottom with an integral mounting base 7. Inside the housing 1, a discharge chamber 9 communicating with the discharge port 1*b*, an inlet chamber 11 communicating with the inlet port 1*a*, and a drive chamber 15 accommodating a drive means 13 are respectively defined one above another by a first and a lower partitioning wall 17, 19 in the form of an upper and a lower partitioning wall.

In the inlet chamber 11, a first and a second scroll member 21, 23 facing each other are disposed one over another. The second scroll member 23 has a lower end disk 23*a* and a second spiral scroll vane 23*b* formed integrally with and projecting from the top of the lower end disk 23*a*. The lower end disk 23*a* has a shaft 23*c* extending downward from the center of the its lower surface. The shaft 23*c* is rotatably received in an axial hole 19*a* formed in a central portion of the lower partitioning wall 19, which is integral with the cylindrical peripheral wall 1*c* of the housing 1. The first scroll member 21 has an upper end disk 21*a* and a first spiral scroll vane 21*b* formed integrally with and projecting from the bottom of the upper end disk 21*a* and meshing with the second scroll vane 23*b*. The upper end disk 21*a* has a hollow shaft 21*c* extending upward from the center of its top. The shaft 21*c* is eccentric with respect to the shaft 23*c* of the lower end disk 23*a*, and it is rotatably received via a bearing 25 in an axial hole 17*a* formed in the upper partitioning wall 17, which is integral with the cylindrical peripheral wall 1*c* of the housing 1. On a portion of the shaft 21*c* extending upward from the axial hole 17*a* are fitted a substantially annular-shaped spacer 27 and a bearing retainer 29 in the order described. The bearing retainer 29 and the spacer 27 are secured to the upper surface of the upper partitioning wall 17 by tightening a nut 31 fitted on the shaft 21*c* from above the bearing retainer 29. The upper end of the shaft 21*c* is rotatably supported via a bearing 33 in the bearing retainer 29.

The first and second scroll vanes 21*b* and 23*b* are disposed such that they mesh with each other and define therebetween a plurality of variable-volume chambers 35, the volumes of which are variable, and which are substantially crescent in plane. The upper and lower end surfaces of the respective second and first scroll vanes 23*b* and 21*b* are in contact with the corresponding inner surfaces of the upper and lower end disks 21*a* and 23*a*, and they are formed with respective spiral seal grooves in the form of spirally extending continuous channels; in which are accommodated seal members 37 and 39 such as tip seals for making hermetical seals between contacting parts of the upper and lower end surfaces of the second and first scroll vanes 23*b*, 21*b* and between the upper and lower end disks 21*a*, 23*a*, respectively.

A continuous axial discharge duct 41 is formed through the shaft 21*c* of the first scroll member 21 and the upper end disk 21*b* for communicating the variable-volume chambers 35, which are defined by substantially central portions of the first and second scroll vanes 21*b* and 23*b*, with the discharge chamber 9 defined in an upper portion of the housing 1. In the discharge duct 41 is provided a check valve 43, which permits a flow of gas from the side of the variable-volume chamber 35 to the side of the discharge chamber 9 and prevents a reverse flow in the opposite direction. The check valve 43 has an annular valve seat 45 provided in the discharge duct 41 and having a central hole 45*a*, and a valve body 47 provided in the discharge duct 41 for selectively opening and closing the hole 45*a* of the valve seat 45. The valve body 47 is biased by biasing means 49 such as a compression coil spring into seating engagement with the valve seat 35 to close the hole 45*a*. Thus, when the pressure in the central or innermost variable-volume chamber 35 exceeds the pressure in the discharge chamber 9 and hence exceeds a biasing force of the biasing means 49, the valve body 47 is separated from and moved off the valve seat 45 against the biasing force of the biasing means 49 to open the hole 45*a*.

Accommodated in the spacer 27 is an oil pump 51 which, in the illustrated example, is of the eccentric rotor type. It this connection, however, any other type of pump can be used for the same purpose. The illustrated oil pump 51 includes a circular pump chamber 51*a* formed in the spacer 27 and communicating with the discharge chamber 9 through a radial oil passage 27*a*, an eccentric rotor 51*b* disposed in the pump chamber 51*a* and mounted on the shaft 21*c* of the first scroll member 21 for eccentric rotation with respect of the center of the pump chamber 51*a* and a vane 51*c* provided on the outer periphery of the eccentric rotor 51*b* for movement in the radial direction. With the rotation of the shaft 21*c*, the eccentric rotor 51*b* is rotated to withdraw oil 53, i.e., lubricant, into the discharge chamber 9 through the oil passage 27*a* for pressurization. The lubricating oil 53 pressurized in this way is supplied from the pump chamber 51*a* through the oil passage 27*b* in the spacer 27, a flow control valve 54 provided on the outer periphery of the spacer 27 and an oil passage 55, which is continuously formed through the spacer 27, upper partitioning wall 17, shaft 21*c* of the first scroll member 21, and upper end disk 21*a*, to the variable-volume chambers 35 formed by the first and second scroll vanes 21*b* and 23*b*. The lubricating oil 53 thus supplied lubricates the rotational sliding parts of the first and second scroll vanes 21*b* and 23*b* and of the upper and lower end disks 21*a* and 23*a*, and it also hermetically seals the contacting portions of the first and second scroll vanes 21*b* and 23*b*. Further, the oil 53 leaking from the variable-volume chambers 35 into the inlet chamber 11 is collected in a lower portion thereof.

Provided between the lower end disk 23*a* of the second scroll member 23 and the lower partitioning wall 19 is a seal means 56 surrounding the shaft 23*c* of the second scroll member 23. The seal means 56 serves to prevent leakage of vacuum and the oil 53 in the inlet chamber 11 to the lower drive chamber 15 through the gap between the outer periphery of the shaft 23*c* and the wall of the axial hole 19*a* in the lower partitioning member 19. The seal means 56 comprises a labyrinth seal 57 disposed to surround the shaft 23*c* of the second scroll member 23, and a first oil seal 59 disposed at a location nearer to the inlet chamber 11 than the labyrinth seal 57 to form a well in the inlet chamber 11 for storing the lubricating oil 53.

The structure of the labyrinth seal 57 will now be described below in detail. The lower partitioning wall 19 has an axially extending stationary annular projection 61 formed adjacent the axial hole 19*a*, and a stationary annular groove 63 formed adjacent and radially outside of the stationary annular projection 61. On the other hand, the lower end disk 23*a* of the second scroll member 23 is provided on its lower surface with a rotatable annular groove 65 surrounding the shaft 23*c* in a concentric relation, and an axially extending rotatable annular projection 67 disposed adjacent and concentric with the annular groove 65. The stationary and rotatable annular projections 61 and 67 are each fitted, with slight gaps, in the respective annular grooves 65 and 63, thus forming the labyrinth seal 57.

Figure 3:
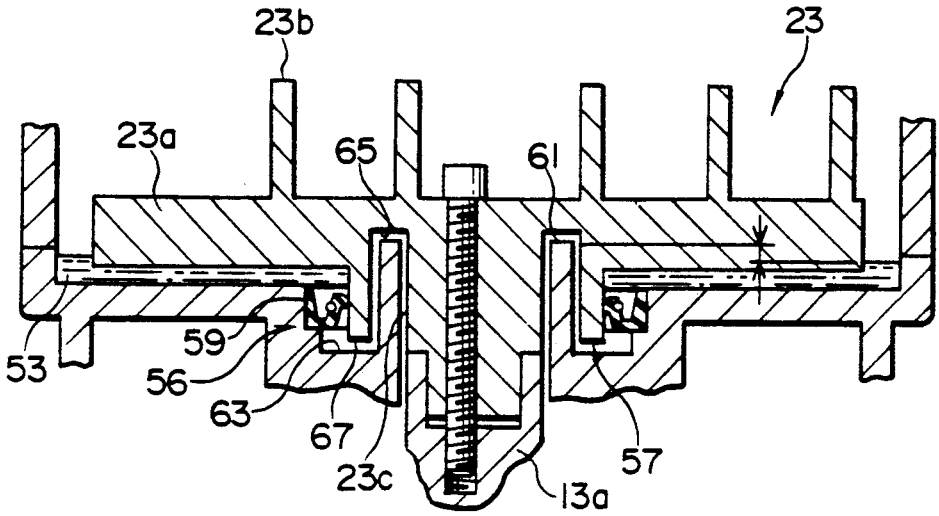
FIG. 3 is a fragmentary sectional view showing the state of lubricating oil when the drive means of FIG. 1 is out of operation.

The first oil seal 59 is disposed in the stationary annular groove 63 of the lower partitioning wall 19 in close contact with the outer periphery of the rotatable annular projection 67. As illustrated on an enlarged scale in FIG. 4, the first oil seal 59 comprises an annular elastic body 59*a* formed of an elastomeric material such as rubber having an annular seal lip 59*a* integrally formed at the radially inner side thereof, an annular reinforcement 59*b* of an L-shaped cross section formed of steel and embedded in the annular elastic body 59*a*, and an annular spring 59*c* for urging the seal lip 59*a* in a radially inward direction into intimate sealing contact with the outer peripheral surface of the rotatable annular projection 67. Thus, the first oil seal 59 serves to prevent leakage of the oil 53 from the inlet chamber 11 to the drive chamber 15 as well as leakage of vacuum from the inlet chamber 11 to the drive chamber 15, i.e., a flow of gas from the drive chamber 15 to the inlet chamber 11. It is desirable that the height or axial dimension of the stationary annular projection 61 of the lower partitioning member 19 be greater than the level of the oil 53 in the inlet chamber 11, as shown in FIG. 3. This is because if oil enters the labyrinth seal 57 through the first oil seal 59 due to wear or deterioration thereof or other causes, it is prevented by the stationary annular projection 61 from leaking toward the drive chamber 15.

The drive means 13 is disposed in the drive chamber 15 comprises, in the illustrated example, an electric motor which has an output or rotary shaft 13*a* thereof rotatably supported by the lower partitioning wall 19 and the base 7 via respective upper and lower end bearings 71 and 72. The shaft 23*c* of the second scroll member 23 is secured to and made integral by a bolt 73 with the upper end of the motor shaft 13*a*. A rotor 13*b* is mounted on the output shaft 13*a* of the motor 13, while a stator 13*c* is secured to the cylindrical peripheral wall 1*c* of the housing 1. When the motor 13 is energized, the motor shaft 13*a* is rotated to drive the second scroll member 23.

Figure 11:
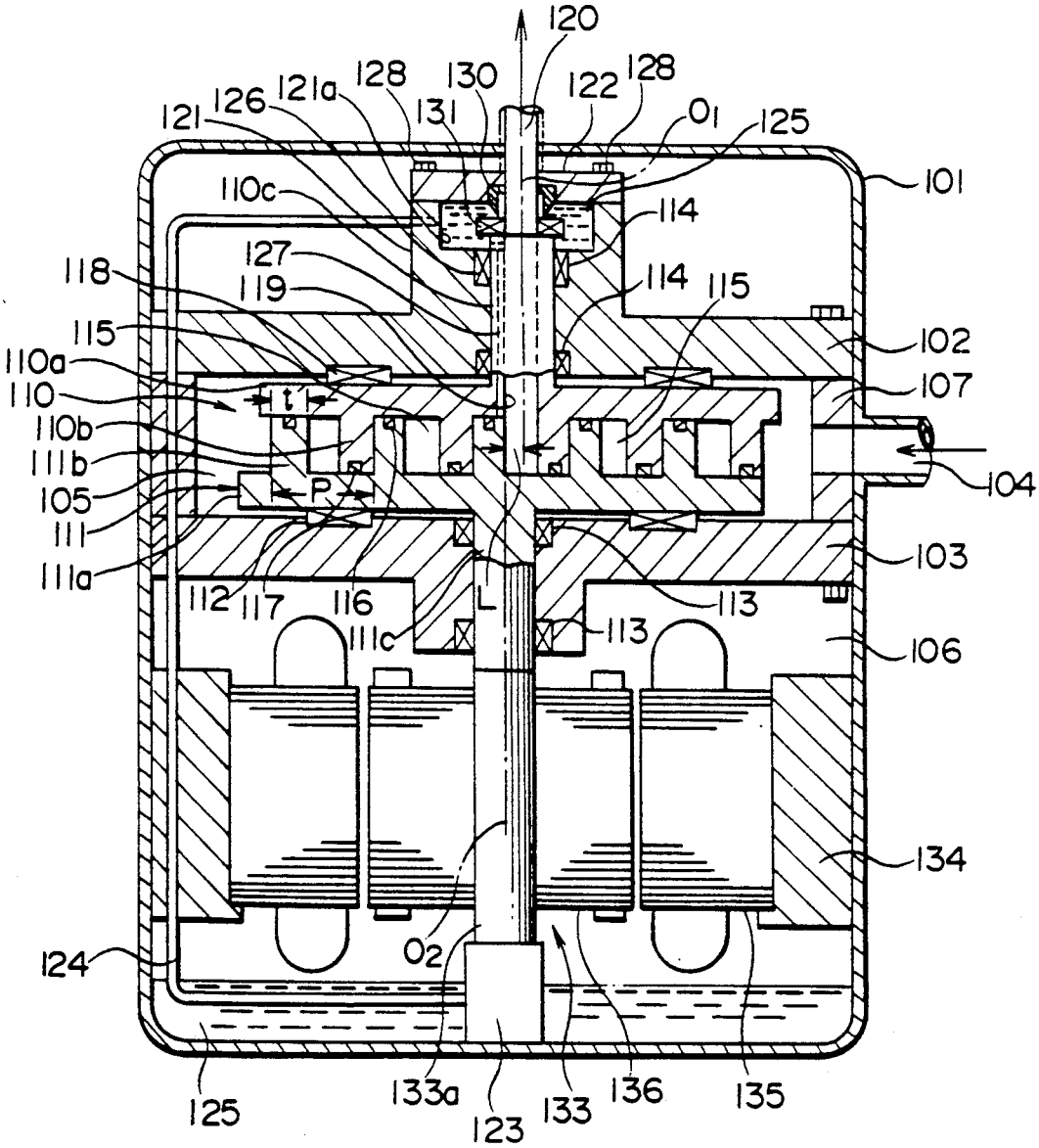
FIG. 11 PRIOR ART
FIG. 11 is a sectional view showing a known scroll-type fluid apparatus.
Figure 12:
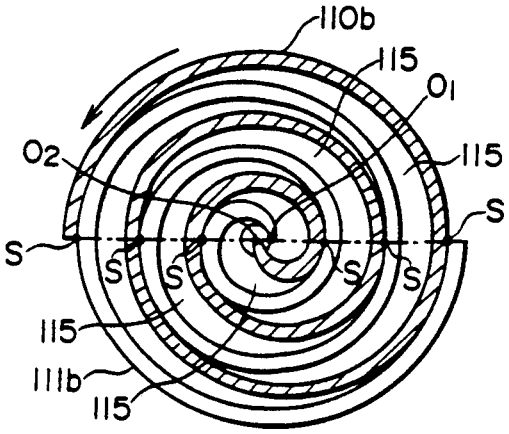
FIGS. 12(*a*) through 12(*d*) are plan views showing a first and a second scroll vane in different operating states of the scroll-type fluid apparatus of FIG. 11.
Figure 12:
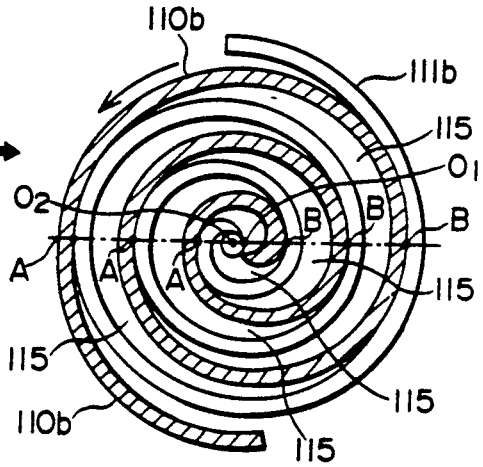
Figure 12:
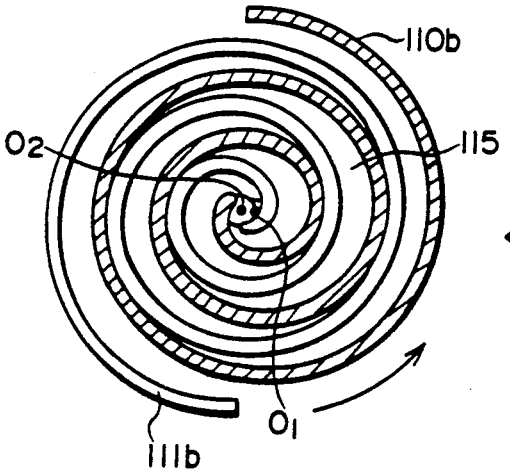
Figure 12:
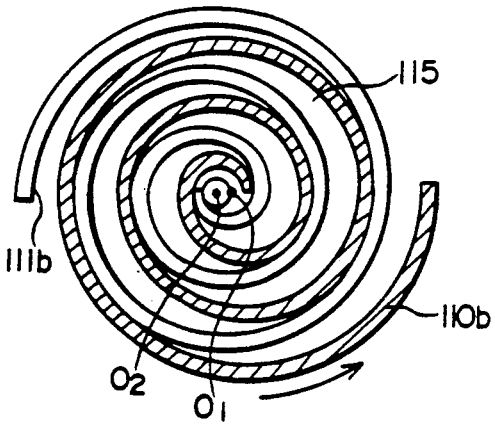

The pumping operation of this embodiment is the same as with the known scroll-type fluid apparatus illustrated in FIG. 11, and hence detailed description thereof is omitted..

Now, the operation or function of the oil 53 will mainly be described. When the motor 13 is rotated, the oil 53 in the discharge chamber 9 is drawn into the oil pump 51 through the oil passage 27*a* and is supplied through the flow control valve 54 and the oil passage 55 to the variable-volume chambers 35 defined by the scroll vanes 21*b* and 23*b* of the first and second scroll members 21 and 23. The oil 53 thus supplied lubricates the rotational sliding parts of the first and second scroll vanes 21*b* and 23*b*, the upper and lower end disks 21*a* and 23*a*, and contacting parts of the scroll vanes 21*b* and 23*b*, and then its substantial portion is discharged along with gas, which has been drawn from an object (not shown) connected to the inlet tube 3 via the same and the inlet port 1*a*, through the variable-volume chambers 35 and the discharge duct 41 extending through the upper end disk 21*a* and the shaft 21*c* to the discharge chamber 9.

However, a portion of the remaining oil 53 leaks through gaps between the first and second scroll vanes 21*b*, 23*b* and the upper and lower end disks 21*a*, 23*a* on one hand, and through gaps between contacting parts of the scroll vanes 21*b* and 23*b* on the other hand, to the inlet chamber 11 where it is collected in a lower portion thereof. But the oil 53 thus collected is partially splashed back by the rotating lower end disk 23*a* of the second scroll member 23 so that it is drawn into the variable-volume chambers 35 and discharged therefrom through the discharge duct 41 to the discharge chamber 9. The amount of oil 53 collected in the lower portion of the inlet chamber 11 comes to an equilibrium when its increment (i.e., the amount of oil leaked from the variable-volume chambers 35) and its decrement (i.e, the amount of oil supplied back to the variable-volume chambers 35) become equal to each other.

Figure 2:
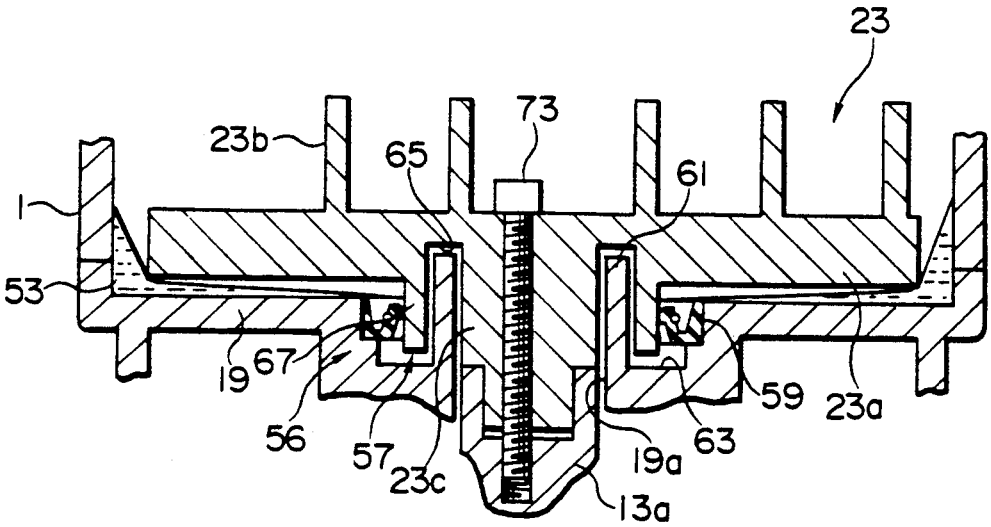
FIG. 2 is a fragmentary sectional view showing the state of lubricating oil when a drive means shown in FIG. 1 is in operation.

During the rotation of the motor 13, the surface of the oil 53 in the inlet chamber 11 is inclined such that it is higher at locations adjacent to the radially outer periphery of the inlet chamber 11 and lower at locations adjacent to the radially inner periphery thereof, as shown in FIG. 2, due to the influence of centrifugal forces produced by the rotation of the lower end disk 23*a* of the second scroll member 23. While the motor 13 is stationary, on the other hand, the oil 53 has a fixed level, as shown in FIG. 3. In this way, the oil 53 collected in a lower portion of the inlet chamber 11 is blocked or prevented from flowing out into the drive chamber 15 by names of the first oil seal 59 provided on the outer periphery of the labyrinth seal 57.

Thus, the first oil seal 59 is filled with the oil 53 at all times, so that the sealing portions of the oil seal 59, i.e., rotational sliding parts of the inner periphery of the oil seal 59 and the outer periphery of the rotatable annular projection 67 of the lower surface of the lower end disk 23*a* of the second scroll member 23, are always lubricated by the oil 53. Thus, the first oil seal 59 is never subjected to abnormal wear due to lack of lubricating oil 53 and can reliably prevent the flow of gas from the drive chamber 15 to the inlet chamber 11 to maintain vacuum in the inlet chamber 11.

Further, since the oil level in the inlet chamber 11 is lower than the height of the stationary annular projection 61 axially projecting from the inner periphery of the lower partitioning wall 19 when the motor 13 is in a deenergized state, if oil 53 having passed through the oil seal 59 is about to enter the labyrinth seal 57, it is blocked by the stationary annular projection 61 from leaking into the drive chamber 15 accommodating the motor 13.

Figure 5:
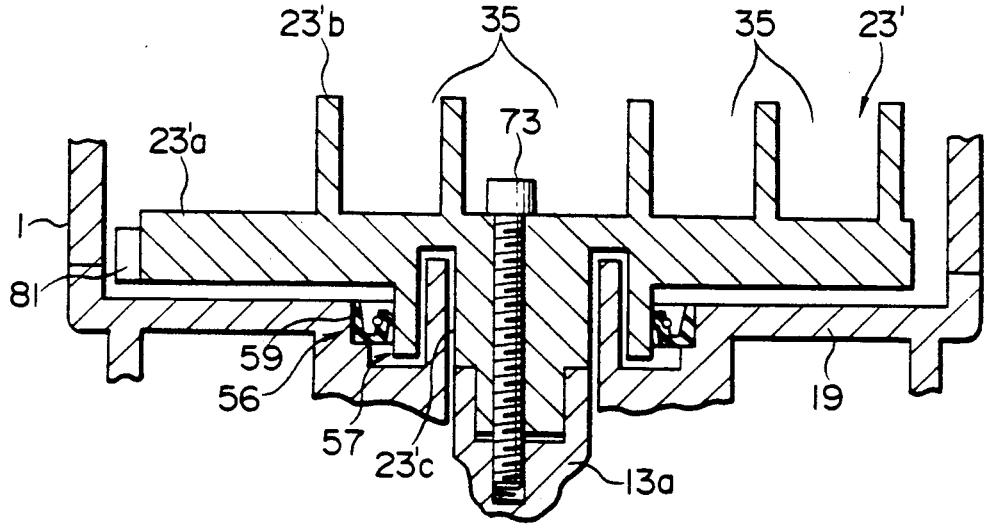
FIG. 5 is a fragmentary sectional view showing a modification of a second scroll member shown in FIG. 1.
Figure 6:
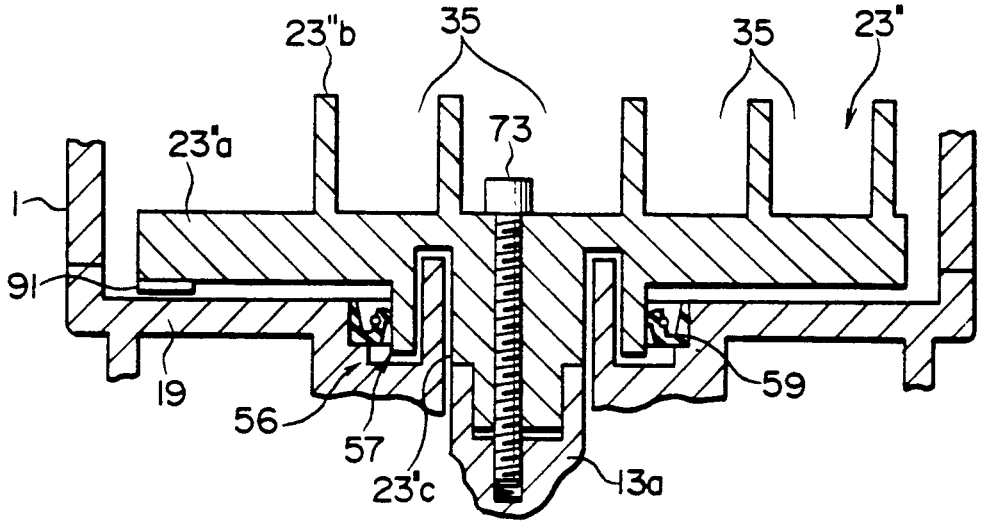
FIG. 6 is a fragmentary sectional view showing another modification of the second scroll member of FIG. 1.

FIGS. 5 and 6 respectively show different modifications of the second scroll member. In the modification of FIG. 5, a lower end disk 23'*a* of a second scroll member 23' has a plurality of radial projections 81 (only one is illustrated) each extending radially outwardly from the outer periphery thereof. The radial projections 81 are circumferentially spaced from each other around the outer periphery of the lower end disk 23'*a*, and the number thereof may be arbitrarily determined as necessary. In the modification of FIG. 6, a lower end disk of 23''*a* of a second scroll member 23'' is provided adjacent the outer periphery thereof with a plurality of axial projections 91 (only one is illustrated) extending downwardly from the lower surface thereof. The axial projections 91 are circumferentially spaced from each other around the outer periphery of the lower end disk 23''*a*, and the number thereof may be arbitrarily determined as necessary. With these structures, the rotation of the lower end disks 23'*a* or 23''*a* can cause oil 53 in a lower portion of the inlet chamber 11 to be efficiently stirred or splashed by the peripheral projections 81 or 91, thus returning as much oil 53 as possible into the variable-volume chambers 35.

In the above embodiment shown in FIGS. 1 to 6, the oil seal 59, has the upwardly directed main lip 59'*a* which is in sealing contact with the outer periphery of the rotatable annular projection 67 projecting from the lower surface of the second scroll member 23. This has an effect of increasing the vacuum in the inlet chamber 11. However, since the oil seal 59 itself provides a slight pumping action to supply the oil 53 from the drive chamber 15 to the inlet chamber 11, there is a possibility of oil leakage.

Figure 7:
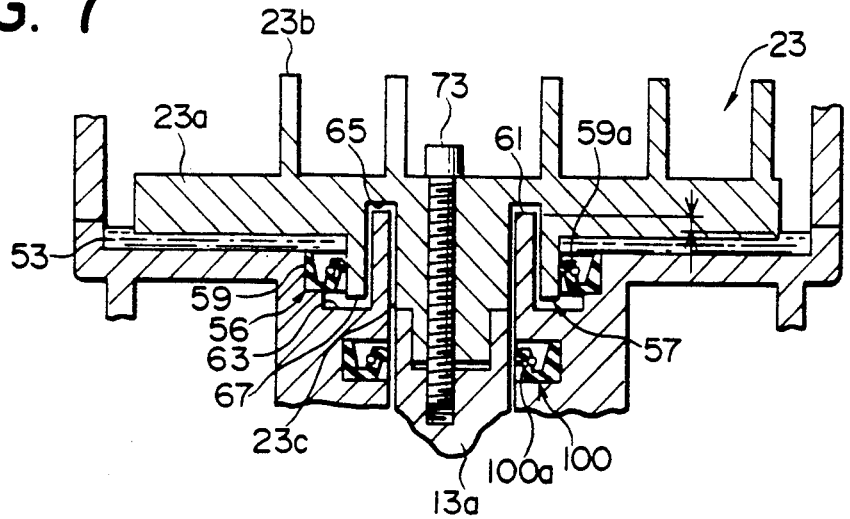
FIG. 7 is a view similar to FIG. 3 but showing a further embodiment of the invention.
Figure 8:
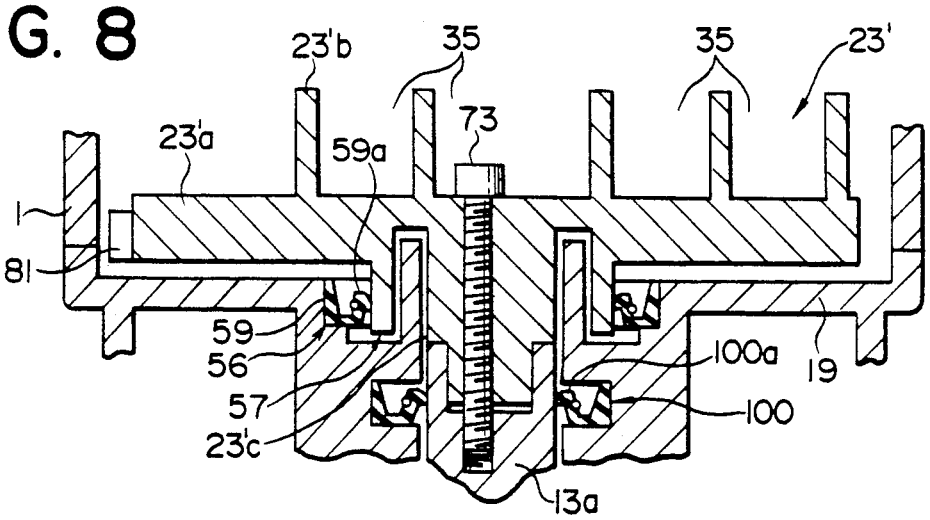
FIG. 8 is a fragmentary sectional view showing a modification of a second scroll member shown in FIG. 7.
Figure 9:
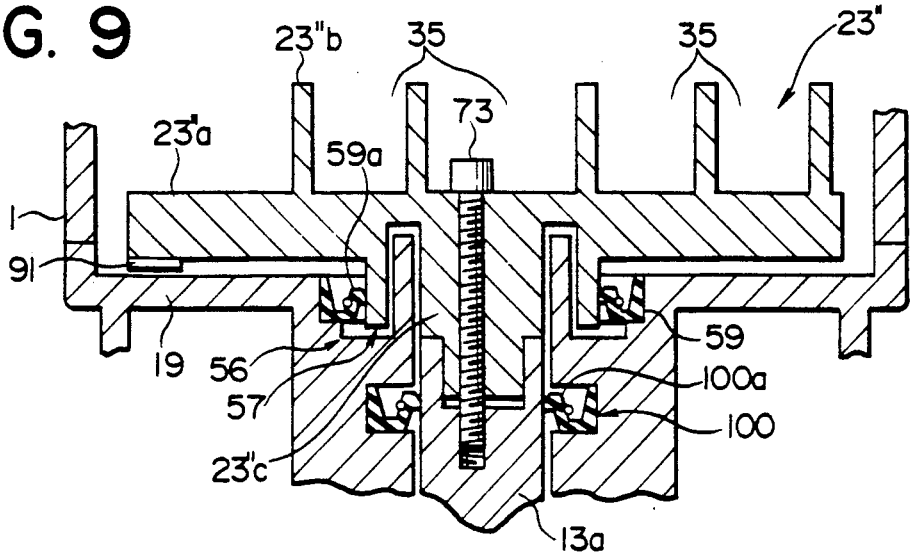
FIG. 9 is a fragmentary sectional view showing a further modification of the second scroll member of FIG. 7.

FIGS. 7 to 9 respectively show different embodiments, all of which can further improve the sealing performance with respect to the oil 53.

Figure 4:
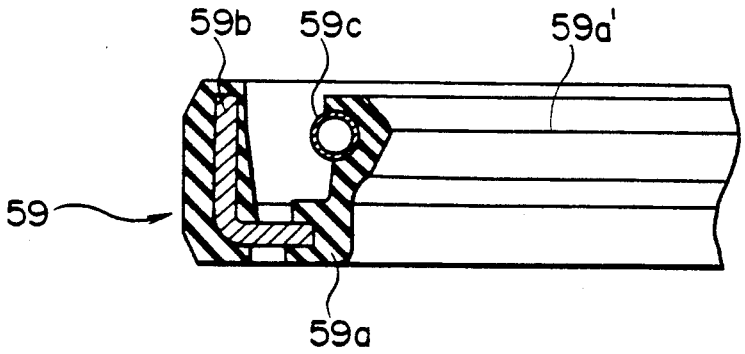
FIG. 4 is a partial cross section, on an enlarged scale, of a first oil seal shown in FIGS. 2 and 3.

The embodiments of FIGS. 7 to 9 correspond respectively to the embodiments of FIGS. 4 to 6, and like parts are designated by like reference symbols. In these embodiments, an oil seal 59 has a main lip 59*a'* directed upwardly in order to improve the sealing performance of the oil seal 59 with respect to the oil 53. The oil 53, which leaks from the inlet chamber 11 through the oil seal 59 toward the labyrinth seal 57 during rotation of the shaft 13*a*, is returned to the inlet chamber 11 by the pumping action of the main lip 59*a'* of the oil seal 59. This orientation in the arrangement of the oil seal 59, however, makes it easier for the gas in the drive chamber 15 to be introduced through the oil seal 59 into the inlet chamber 11, thus reducing a vacuum holding capability. To increase the vacuum holding capability, it is desirable that another or a second oil seal 100 be disposed at a location below the labyrinth seal 57 in such a manner as to surround the oute- periphery of the shaft 23*c* of the second scroll member 23. This oil seal 100 is also suitably disposed such that its main lip 100*a* is directed upwardly i.e., in such a manner as to prevent leakage of the oil 53 from the inlet chamber 11 toward the drive chamber 15. With this arrangement of the second oil seal 100, oil 53 may be collected in an upper portion of the second oil seal 100 to lubricate a sealing portion of the main lip 100*a* which is in sealing contact with the outer periphery of the shaft 23*c*.

Figure 10:
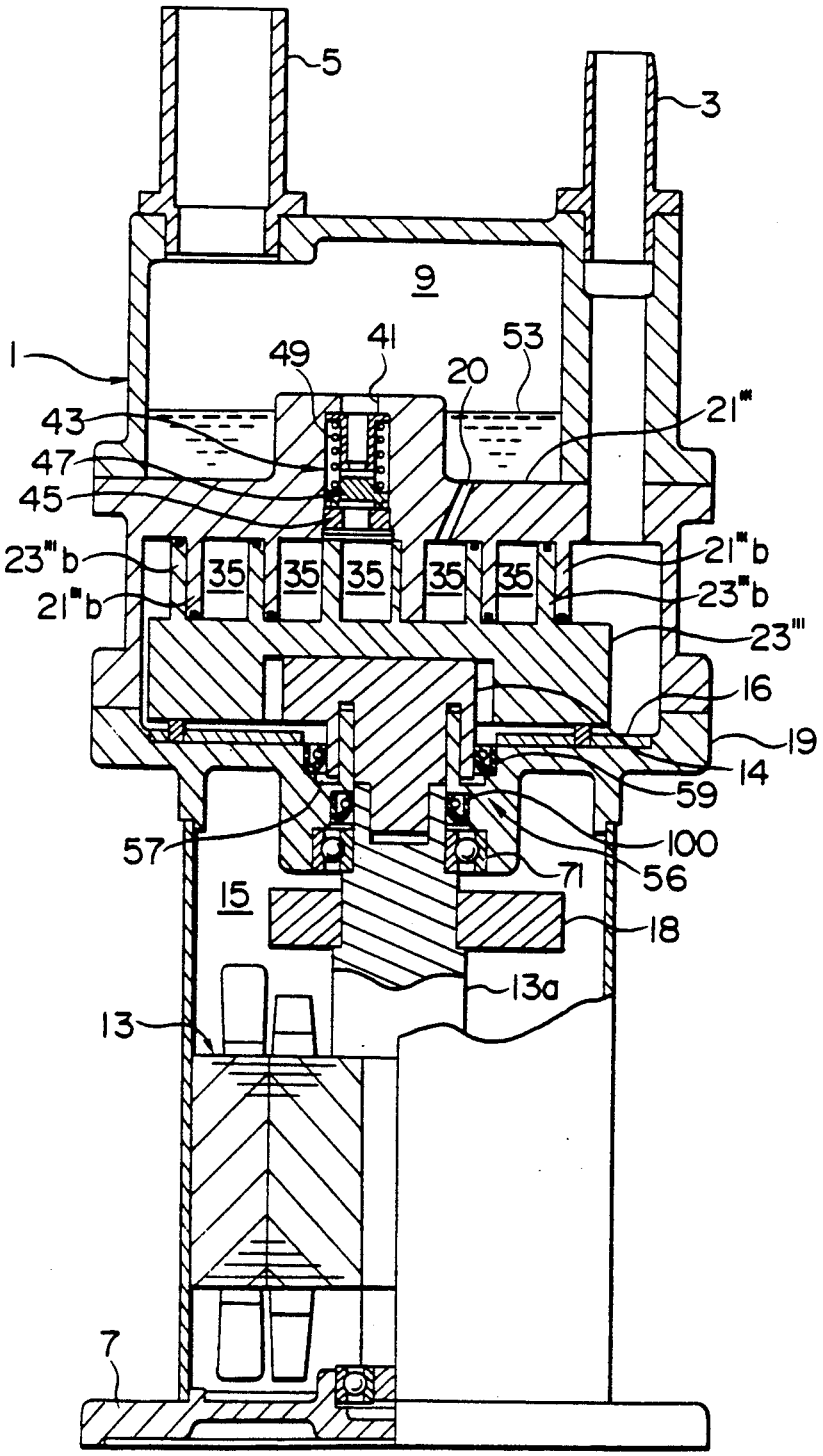
FIG. 10 is a view similar to FIG. 1, but showing a still further embodiment of the invention.

FIG. 10 shows a further embodiment of the invention which is substantially similar to the first mentioned embodiment of FIG. 1 except for the following features.

Specifically, in this embodiment, a first scroll member 21''' is fixedly secured to or integrally formed with a first or upper partitioning wall to form an integral structure. A second scroll member 23''' is disposed in an inlet chamber 11 in an eccentric relation with respect to the first scroll member 21''' and operatively connected through a rotatable shaft 14 with an output shaft 13*a* of a drive means 13 in the form of an electric motor 13. In this embodiment, the rotatable shaft 14 comprises an eccentric rotor which is formed separately from the second scroll member 23'''. The eccentric rotor 14 is operatively connected with the second scroll member 23''' and the output shaft 13*a* of the motor 13 in an eccentric manner such that the second scroll member 23''' is caused to orbit around a central axis of the first scroll member 21''' by the motor 13. An angular-phase holding means 16 is provided for holding a predetermined angular phase between the first and second scroll members 21''', 23'''' during orbital movement of the second scroll member 23'''. The angular-phase holding means 16 comprises a conventional Oldham's coupling which is disposed between the second scroll member 23''' and the second or lower partitioning wall 19. When the motor 13 is energized, the second scroll member 23''' is caused to perform oscillatory or orbital motion around the central axis of the first scroll member 21''' by rotation of the motor shaft 13*a* through the eccentric rotor 14, thereby changing the volumes of variable-volume chambers 35 defined by and between the first and second scroll members 21''', 23''', as in the embodiment of FIG. 1. The Oldham's coupling 16 is well known in the art, and one example of this is described in Japanese Patent Publication Serial No. 1-16347 which was assigned to the same assignee as in this application and published on Mar. 23, 1989. Thus, the related description made therein is hereby incorporated in the body of the description of the present application. A balancer 18 is mounted on the motor shaft 13*a* for offsetting an unbalanced rotary moment applied to the motor shaft 13*a* by the eccentric rotor 14 during rotation thereof.

Provided between the second or lower partitioning wall 19 and the eccentric rotor 14 is a seal means 56 which comprises a labyrinth seal 57 surrounding a lower portion of the eccentric rotor 14 and a first oil seal 59 disposed radially outside of the labyrinth seal 57 in a surrounding relation. Also, a second oil seal 100 is provided between the radially inner periphery of the second or lower partitioning wall 19 and the outer periphery of the motor shaft 13*a*. The labyrinth seal 57 and the first and second oil seals 59, 100 are substantially similar in construction and operation to those of the previously mentioned embodiment of FIGS. 7 through 9.

Moreover, in this embodiment, the oil pump 51 of FIG. 1 is omitted and instead one or a plurality of oil passages 20 are formed through the first scroll member 21''' for permitting lubricating oil 53 in the discharge chamber 9 to be supplied or drawn into the variable-volume chambers 35 between the first and second scroll members 21''', 23''' under the action of a pressure differential therebetween.

Although in the above embodiments, a scroll-type vacuum pump is described as one example of a scroll-type fluid apparatus, it can be utilized as a compressor by connecting the discharge tube 5 with an external object such as a fluid machine, to which fluid in the variable-volume chambers 35, being compressed by relative rotation of the first and second scroll vanes 21*b*, 23*b*, is supplied through the discharge tube 5.

As has been described in the foregoing, according to the invention, the interior of a housing is partitioned by a first and a second partitioning wall to define an inlet chamber, which communicates with an inlet port and accommodates a first and a second scroll member, and a drive chamber accommodating a drive means. Seal means is provided on the outer periphery of a rotatable shaft of the second scroll member for preventing lubricating oil in the inlet chamber from leaking to the drive chamber. The seal means comprises a labyrinth seal disposed to surround the rotating shaft of the second scroll member, and a first oil seal which is disposed at a location nearer to the inlet chamber side than the labyrinth seal and serves to provide a well in the inlet chamber for storing the lubricating oil. Thus, even if water and/or corrosive fluid contained in an operating fluid, which is drawn from the exterior through the inlet port into the inlet chamber, is introduced into or mixed with the lubricating oil during operation of the apparatus, the lubricating oil containing such introduced water and/or corrosive fluid are positively blocked from entering the drive chamber, so resultant corrosion or failure of the drive means in the drive chamber can be avoided in a highly reliable manner.

What is claimed is:

1. A scroll-type fluid apparatus comprising:

a housing having an inlet port for drawing fluid and a discharge port for discharging the fluid, said housing having an inlet chamber defined between a first and a second partitioning wall and communicating with said inlet port, and a drive chamber defined by said housing and at least one of said first and said second partitioning walls, said inlet chamber having lubricating oil therein;

a first scroll member disposed in said inlet chamber and supported by said first partitioning wall, said first scroll member being provided on one surface thereof with a first spiral scroll vane, said first scroll member having a discharge passage formed through a central portion thereof for communication with said discharge port;

a second scroll member disposed in said inlet chamber in an eccentric relation with respect to said first scroll member and being provided on one surface thereof with a second spiral scroll vane which is in mesh with said first scroll vane to define, in cooperation therewith, a plurality of variable-volume chambers, said first and second scroll members having sliding portions which are lubricated by at least the lubricating oil in said inlet chamber;

a rotatable shaft connected with the other surface of said second scroll member and extending through said second partitioning wall, said rotatable shaft being rotatably supported by said second partitioning wall;

drive means disposed in said drive chamber and coupled to said rotatable shaft of said second scroll member for rotatively driving it so that said second scroll member is thereby rotated to change the volumes of said variable-volume chambers whereby fluid is drawn through said inlet port into said variable-volume chambers, varied in its volume and discharged from said discharge port through said discharge passage in said first scroll member; and seal means for preventing the lubricating oil in said inlet chamber from leaking around the outer periphery of said rotatable shaft of said second scroll member into said drive chamber, said seal means comprising a labyrinth seal disposed to surround said rotatable shaft of said second scroll member, and a first oil seal disposed at a lower portion of said inlet chamber so as to provide a well in said inlet chamber for storing the lubricating oil.

2. A scroll-type fluid apparatus according to claim 1, wherein said rotatable shaft is fixedly connected with said second scroll member, and said first scroll member is rotatably supported by said first partitioning wall so that it is driven to rotate by said second scroll member in a predetermined angular phase with respect to the latter.

3. A scroll-type fluid apparatus according to claim 2, wherein said first scroll member is driven to rotate by said second scroll member through frictional engagement therebetween, while following the rotation of the latter.

4. The scroll-type fluid apparatus according to claim 2, wherein said labyrinth seal comprises:

a rotatable annular groove formed on the other surface of said second scroll member so as to surround said rotatable shaft in a concentric relation therewith;

a rotatable annular projection provided on said second scroll member at a location adjacent said rotatable annular groove;

a stationary annular projection provided on said second partitioning wall and fitted in said rotatable annular groove; and a stationary annular groove provided on said second partitioning wall at a location adjacent said stationary annular projection and fitted over said rotatable annular projection.

5. A scroll-type fluid apparatus according to claim 4, wherein said stationary annular projection has an axial height higher than a surface of the lubricating oil in said inlet chamber when said second scroll member is in a stationary state.

6. A scroll-type fluid apparatus according to claim 1, wherein said first scroll member is fixedly secured to said first partitioning wall, and said rotatable shaft comprises an eccentric rotor which is formed separately from said second scroll member, said rotor being operatively connected with said second scroll member and an output shaft of said drive means in an eccentric manner such that said second scroll member is caused to orbit around a central axis of said first scroll member by said drive means, said apparatus further comprising angular-phase holding means for holding a predetermined angular phase between said first and second scroll members during orbital movement of said second scroll member.

7. The scroll-type fluid apparatus according to claim 6, wherein said labyrinth seal comprises:

a rotatable annular groove formed on the other surface of said second scroll member so as to surround said rotatable shaft in a concentric relation therewith;

a rotatable annular projection provided on said second scroll member at a location adjacent said rotatable annular groove;

a stationary annular projection provided on said second partitioning wall and fitted in said rotatable annular groove; and a stationary annular groove provided on said second partitioning wall at a location adjacent said stationary annular projection and fitted over said rotatable annular projection.

8. A scroll-type fluid apparatus according to claim 7, wherein said stationary annular projection has an axial height higher than a surface of the lubricating oil in said inlet chamber when said second scroll member is in a stationary state.

9. A scroll-type fluid apparatus according to claim 1, wherein said seal means further comprises a second oil seal disposed at a location farther from said inlet chamber than said labyrinth seal for effecting sealing against the outer periphery of said rotatable shaft.

10. A scroll-type fluid apparatus according to claim 1, wherein said first oil seal has a main lip directed with such an orientation as to block a flow of the lubricating oil from said inlet chamber to said drive chamber.

11. A scroll-type fluid apparatus according to claim 9, wherein said second oil seal has a main lip directed with such an orientation as to block a flow of the lubricating oil from said inlet chamber to said drive chamber.

12. A scroll-type fluid apparatus according to claim 1, wherein said second scroll member has splashing means for splashing the lubricating oil in said inlet chamber.

13. A scroll-type fluid apparatus according to claim 12, wherein said splashing means comprises at least one radial projection formed on and extending radially outward from the outer periphery of said second scroll member.

14. A scroll-type fluid apparatus according to claim 12, wherein said splashing means comprises at least one axial projection formed on and extending axially from the other surface of said second scroll member.

15. A scroll-type fluid apparatus according to claim 1, wherein said housing further has a discharge chamber defined therein by said first partitioning wall on that side thereof which is opposite the side thereof facing said inlet chamber, said discharge chamber being in fluid communication with said discharge port, and said first scroll member has a hollow rotatable shaft which extends from a central part of said first spiral scroll vane through said first partitioning wall to said discharge chamber for guiding the fluid discharge from said variable-volume chambers toward said discharge chamber.

16. A scroll-type fluid apparatus according to claim 15, further comprising an oil pump provided on said hollow rotatable shaft of said first scroll member, said oil pump being driven by rotation of said hollow rotatable shaft for supplying part of the lubricating oil to said spiral scroll vanes of said first and second scroll members.

17. A scroll-type fluid apparatus according to claim 1, wherein said drive means comprises an electric motor.

18. A scroll-type fluid apparatus according to claim 1, wherein said scroll-type fluid apparatus is a vacuum pump.

19. A scroll-type fluid apparatus according to claim 1, wherein said scroll-type fluid apparatus is a compressor.

* * * * *